US008202201B2

(12) United States Patent
Baheti

(10) Patent No.: US 8,202,201 B2
(45) Date of Patent: Jun. 19, 2012

(54) STATIONARY EXERCISE SCOOTER

(75) Inventor: Neeraj Dwarkadas Baheti, San Jose, CA (US)

(73) Assignee: Equilibrium Fitness Solutions, LLC, San Jose, CA (US)

( * ) Notice: Subject to any disclaimer, the term of this patent is extended or adjusted under 35 U.S.C. 154(b) by 0 days.

(21) Appl. No.: 11/964,553

(22) Filed: Dec. 26, 2007

(65) Prior Publication Data

US 2008/0194386 A1 Aug. 14, 2008

Related U.S. Application Data

(60) Provisional application No. 60/878,234, filed on Jan. 3, 2007.

(51) Int. Cl.
*A63B 71/00* (2006.01)

(52) U.S. Cl. ..... 482/8

(58) Field of Classification Search ..... 482/1–8, 482/52, 146–147; 280/210; 463/36; 434/57, 434/61

See application file for complete search history.

(56) References Cited

U.S. PATENT DOCUMENTS

| | | | | | |
|---|---|---|---|---|---|
| 3,331,612 | A | * | 7/1967 | Tietge | 280/11.28 |
| 4,082,265 | A | * | 4/1978 | Berkes | 482/61 |
| 4,749,180 | A | * | 6/1988 | Boomer | 482/51 |
| 4,867,188 | A | | 9/1989 | Reid | |
| 4,925,183 | A | * | 5/1990 | Kim | 482/61 |
| 4,944,309 | A | * | 7/1990 | Mechling | 600/595 |
| 5,385,520 | A | * | 1/1995 | Lepine et al. | 482/54 |
| 5,407,408 | A | * | 4/1995 | Wilkinson | 482/54 |
| 5,413,544 | A | | 5/1995 | Fiore | |
| 5,492,521 | A | * | 2/1996 | Wilkinson et al. | 482/147 |
| 5,518,476 | A | * | 5/1996 | McLeon | 482/79 |
| 5,800,317 | A | | 9/1998 | Acetta | |
| 5,871,421 | A | * | 2/1999 | Trulaske et al. | 482/54 |
| 6,004,243 | A | * | 12/1999 | Ewert | 482/8 |
| 6,056,672 | A | * | 5/2000 | Carbonell Tendero | 482/57 |
| 6,227,555 | B1 | * | 5/2001 | Wang et al. | 280/87.042 |
| 6,334,838 | B1 | | 1/2002 | Lee | |
| 6,485,041 | B1 | | 11/2002 | Janssen | |
| 6,659,486 | B2 | | 12/2003 | Eschenbach | |
| 6,715,779 | B2 | | 4/2004 | Eschenbach | |
| 6,837,504 | B2 | | 1/2005 | Garner | |
| 6,857,648 | B2 | | 2/2005 | Mehmet | |
| 6,878,101 | B2 | * | 4/2005 | Colley | 482/54 |
| 6,893,382 | B1 | * | 5/2005 | Moon et al. | 482/54 |
| 7,081,074 | B1 | * | 7/2006 | Rubin | 482/146 |
| 7,220,219 | B2 | * | 5/2007 | Papadopoulos et al. | 482/57 |
| 2002/0039952 | A1 | * | 4/2002 | Clem | 482/8 |
| 2002/0137610 | A1 | * | 9/2002 | Broudy et al. | 482/147 |
| 2002/0147087 | A1 | * | 10/2002 | Tollner | 482/147 |

(Continued)

FOREIGN PATENT DOCUMENTS

| | | | |
|---|---|---|---|
| GB | 2387824 | A | 10/2003 |
| GB | 2387824 | A * | 10/2003 |

*Primary Examiner* — Loan Thanh
*Assistant Examiner* — Shila Jalalzadeh Abyane
(74) *Attorney, Agent, or Firm* — Original, LLC; Andrew F. Martz

(57) ABSTRACT

The invention is a stationary exercise scooter device and method of operation for improved physical fitness, physical therapy, strength, balance, mental fitness and entertainment, enabling a user to actualize balance and cardiopulmonary exercise benefits from side to side movement, and simulated forward movement of an unstable board or scooter, with the physical demands of riding the device within a proximate space of the device as a whole.

11 Claims, 8 Drawing Sheets

U.S. PATENT DOCUMENTS

2003/0025291 A1* 2/2003 Fong ..... 280/210
2005/0009668 A1* 1/2005 Savettiere et al. ..... 482/66
2007/0027009 A1* 2/2007 Arnold ..... 482/146
2007/0142177 A1* 6/2007 Simms et al. ..... 482/8
2007/0184953 A1* 8/2007 Luberski et al. ..... 482/146

* cited by examiner

10

STATIONARY EXERCISE SCOOTER

BACKGROUND OF THE INVENTION

I. Field of the Invention

The invention relates to exercise devices used for improved physical balance, cardiopulmonary exercise, strength, physical fitness, proprioception, mental fitness, and entertainment purposes.

II. State of the Art

Exercise and exercise equipment are increasingly important in the modern world as time spent by individuals becomes more docile, and the needs for physical movement are consequently limited by modern mobility devices such as automobiles, elevators, escalators, moving sidewalks, airplanes, drive-through eating establishments, golf carts, and a host of other amenities. Work itself has become less physically active through urban migration from the fields to the cities. Even in rural, agricultural environments, where physical labor was once part and parcel with economic production, modern mechanization and labor saving devices have eliminated the need for much of the physical work previously performed in traditionally labor intensive industries. Additionally, the growth of a knowledge economy, computing devices, and modern telecommunications obviate many of the prior needs for physical meetings that were once a necessity of human communication, and that often require physical travel and at least a component of physical movement or exercise.

Though this trend has developed for more than a century, the growth of the exercise equipment industry in recent decades illustrates a growing demand across the broad population for equipment and tools that enable the fulfillment of their needs for physical exercise, physical therapy, and recreational diversions from their busy, but often sedentary, working lives. Furthermore, as sedentary lifestyles became a norm, so also did the risks of physical injury due to decreased physical fitness and strength.

Yet, as awareness of the benefits of physical fitness expands across the population, there is a wave of newfound athleticism and physical activity. When physical activity is undertaken without proper training and preparation, athletes expose themselves to higher risk for physical injury.

Additionally, life expectancy has increased through modern medical science, and older individuals recognize that physical fitness can enhance their personal enjoyment of life in later years. However, because older athletes generally heal at a slower rate than younger ones, we also see a corresponding rise in physical injuries among this portion of the population.

As the desire for maintenance, enhancement and optimization of physical fitness for the enjoyment of health benefits, prevention of injury, and recovery from injuries continues to increase, individuals are increasingly joining health clubs or purchasing exercise equipment for their homes.

Indoor exercise equipment is one of the fastest growing segments in the exercise equipment market. Home and exercise club uses of these devices are progressively expanding across the nation. The types of available indoor exercise devices have also rapidly diversified. From the iron barbells and leather medicine balls of yesteryear to the modern treadmills, stationary cycles, and mechanical weightlifting devices of today, the field has advanced substantially. To date however, the field lacks a stationary scooter exercise device, which enables unique exercising, physical therapy, and entertainment methods. This Stationary Exercise Scooter invention solves this need.

III. Specifics to the State of the Art

The Applicant is aware of a number of scooter and exercise device inventions related to the proffered invention, including U.S. Pat. Nos.:

3,331,612 A to Tietge, issued Jul. 18, 1967;
4,082,265 to Berkes, issued Apr. 4, 1978;
4,867,188 to Reid, issued Sep. 19, 1989;
4,925,183 to Kim, issued May 15, 1990;
5,407,408 to Wilkinson, issued Apr. 18, 1995;
5,413,544 to Fiore, issued May 9, 1995;
5,492,521 A to Wilkinson, et al., issued Feb. 20, 1996;
5,518,476 A to McLeon, issued May 21, 1996;
5,385,520 to Lepine, et al., issued Jan. 31, 1995;
5,800,317 to Acetta, issued Sep. 1, 1998;
6,004,243 to Ewert, issued Dec. 22, 1999;
6,056,672 to Corbonell Tendero, issued May 2, 2000;
6,227,555 B1 to Wang et al., issued May 8, 2001;
6,344,838 B1 to Lee, issued Jan. 1, 2002;
6,485,041 B1 to Janssen, issued Nov. 26, 2002;
6,659,486 B2 to Eschenbach, issued Dec. 9, 2003;
6,715,779 B2 to Eschenbach, issued Apr. 6, 2006;
6,837,504 B2 to Garner, issued Jan. 4, 2005;
6,857,648 B2 to Mehmet, issued Feb. 22, 2005;
6,878,101 B2 to Colley, issued Apr. 12, 2005;
6,893,382 B1 to Moon, et al., issued May 17, 2005;
7,081,074 B1 to Rubin, issued Jul. 25, 2006;
7,220,219 B2 to Papadopoulos, issued May 22, 2007.

The Applicant is aware of a number of scooter and exercise device inventions related to the proffered invention, including the following publications: 2002 003 9952 A1 by Clem 2002 013 7610 A1 to Broudy 2002 014 7087 A1 by Tollner 2003 002 5291 A1 by Fong, published Feb. 6, 2003; 2005 000 09668 A1 by Savettiere et al., published Jan. 13, 2005; 2007 002 7009 A1 by Arnold 2007 014 2177 A1 by Simms et al., published Jun. 21, 2007; 2007 018 4953 A1 by Luberski The Applicant is aware of the following foreign patent document(s) related to the proffered invention:

United Kingdom patent Number GB 2387824A, issued October 2003.

Viewing the aforementioned known inventions individually and as a whole, there is no suggestion of any configuration that approximates the current invention. A need still exists for an exercise device enabling balance and cardiopulmonary exercise in a proximate space. Furthermore, a need still exists for a device enabling a user to actualize side to side movement, and simulate the forward movement of an unstable board or scooter with the physical demands of riding the device while remaining within a proximate space. While several of the inventions cited present scooter devices with fixed, mechanical, kick pedals to enable locomotion, they lack a device enabling balance and cardiopulmonary exercise in a proximate space, and are all absent of moving or movable kick treads, treadmills, and conveyers enabling scooter movement within a fixed space, simulated scooter propulsion, or limited movement of a scooter within a proximate space of the device as a whole.

SUMMARY OF THE INVENTION

The applicant claims the benefit of U.S. Provisional Patent Application No. 60/878,234, filed Jan. 3, 2007, for a Stationary Exercise Scooter.

The present invention is a stationary exercise scooter device and method of operation. Whereas the awareness of the long-term health benefits from exercise has expanded in recent years, including the benefits for strength, balance, the cardiovascular system, pulmonary system, and the prevention of illness and injury, so has consumer demand for exercise opportunities and devices extraordinarily grown.

As athletes of all ages and skill levels increase their activities, many seek to optimize performance by concentrating their exercise activities in specific muscle groups, for reasons often unique to the particular athlete. Such reasons include better performance in a particular sporting activity, prevention of new or recurring injuries, strength compensation for pre-existing injuries, and the achievement of particular aesthetic results.

Innovation in the exercise equipment field has been expansive, yet to date, the field lacks a stationary exercise scooter device to enable a physical workout commonly experienced by riding a traditional scooter device, enabling simultaneous engagement of separate legs in different exercise activities while remaining stationary with the device as a whole.

Though the field presents a variety of forward moving scooter devices, none approximates the present invention as a stationary scooter exercise device, enabling a user to achieve balance, cardiopulmonary exercise, and simultaneous engagement of separate legs in different exercise activities in a proximate space to actualize side to side movement around a horizontal axis, and simulate forward movement of an unstable platform or scooter, with the physical demands of riding the device within a proximate space, thus enabling both balance, cardiopulmonary exercise, and simultaneous engagement of separate legs in different exercise activities.

The present device solves this need, and enables balance and cardiopulmonary exercise in a proximate space, the side to side balancing exercise commonly experienced when riding a scooter, as well as the kicking motion associated with scooter propulsion, simultaneously engaging separate legs in different exercise activity, all as part of the stationary exercise scooter device as a whole.

BRIEF DESCRIPTION OF THE DRAWINGS

The accompanying figures together illustrate the best mode currently contemplated for the present invention. The figures, in which like reference numerals refer to identical or functionally-similar elements throughout the separate views and which are incorporated in and form part of the specification, serve to illustrate the present invention and, together with the detailed description of the invention, explain the principles of the present invention.

The user maintains side to side balance on the unstable platform with the first leg, while simultaneously kicking with the second leg, to achieve simultaneously unique exercise of different limbs and the desired exercise, physical therapy and entertainment results 8300.

A computer and display provide user feedback from the device and its various components 8400.

DETAILED DESCRIPTION OF THE INVENTION

The particular values and configurations discussed in these non-limiting examples incorporate the accompanying figures and descriptions cited above. They can be varied, and are cited merely to illustrate an embodiment of the present invention. They are not intended to limit the scope of the invention.

The Stationary Exercise Scooter device enables balance training, cardiopulmonary exercise, the exercise and strengthening of specific muscle groups, and entertainment, providing the benefits of scooter and board sport use in limited space. The invention additionally provides enhanced physical workouts enabling exercise concentration on leg and knee muscles.

FIG. 1

Figure 1:
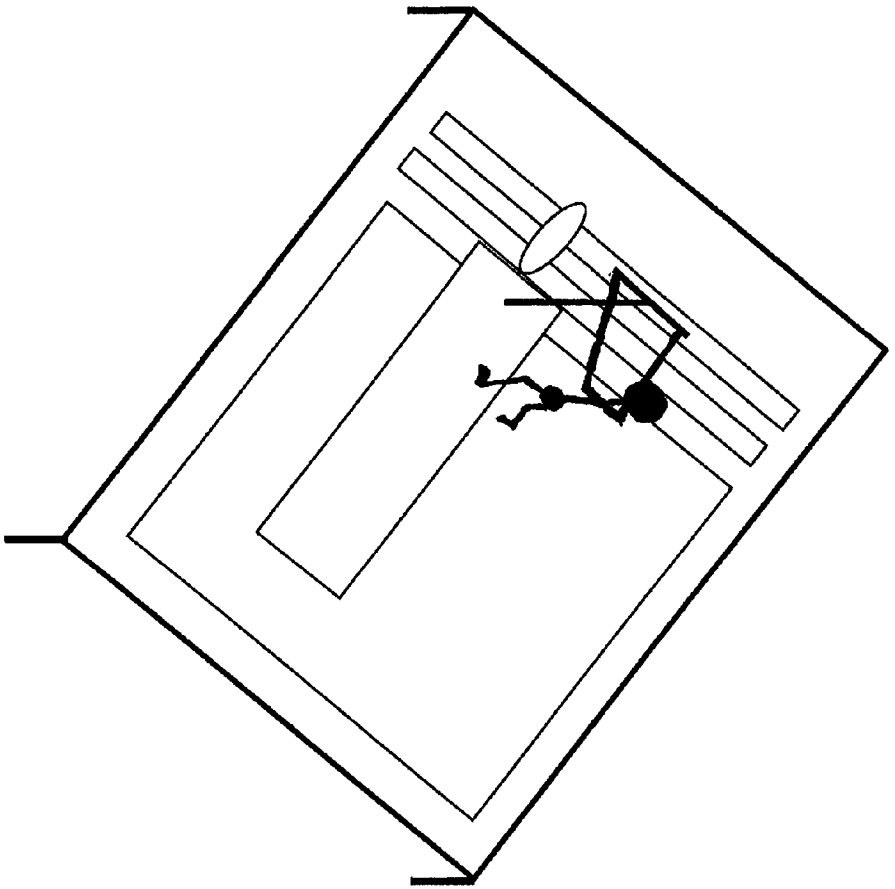
FIG. 1 illustrates an angled, side, top, and rear projection of the present invention in operation by a user in one of many possible methods and modes, and which can be implemented in accordance with the specifications herein. A user balances on an unstable platform, and interfaces with a cardiopulmonary exercise actuator. In this embodiment, the unstable platform is an unstable platform and the cardiopulmonary actuator is a kick tread device. The invention proves an exemplary exercise device in accordance with an embodiment of the present disclosure. For example, an exercise device as shown generally at 10.

FIG. 1 illustrates a person using the present invention in one of many manners of use, shown generally at 10. A user is standing with the left foot on an unstable platform, kicking with the right foot on a cardiopulmonary exercise actuator situated to the left side of the body. It should be appreciated that the user may also stand with the right foot on the unstable platform, and use the left foot for movement. An unstable platform may be comprising various parts. In the best mode, the unstable element is comprising an unstable platform, a balance mechanism, and a platform manipulation mechanism. It should be appreciated, however, that an unstable platform may be comprising one or more different parts, and that those parts may be of different materials or configurations. A cardiopulmonary actuating device is comprising various parts. In the best mode, the cardiopulmonary actuating device is comprising a moveable kick tread on rollers. It should be appreciated, however, that a cardiopulmonary actuating device may be comprising one or more different parts, and that those parts may be of different materials or configurations, or have different mechanical effects. It should also be appreciated that the unstable platform may be positioned in multiple locations on the device, to enable different types of use and to target different limbs, muscle groups, or manners of exercise. Additionally, it should be appreciated that in current or alternate configurations, a user may sit, stand, kneel, lie, ride, or otherwise position oneself on the unstable platform. It should also be appreciated that a user may interface the kick tread with any portion of the user's body to achieve the desired results, or may refrain from interfacing the kick tread at all. There may be more than one user.

It should be appreciated that the present invention may be used as an entertainment device, a gaming device, an arcade device, a mental and physical coordination device, a physical therapy device, a balancing device, and its applications, in conjunction with computing devices and computing applications are many. It should also be appreciated that the current configuration and application may be altered in part or in whole to utilize some or all of the various components, or by adding additional components, to effect a similar, yet alternative resulting exercise or entertainment device.

FIG. 2

Figure 2:
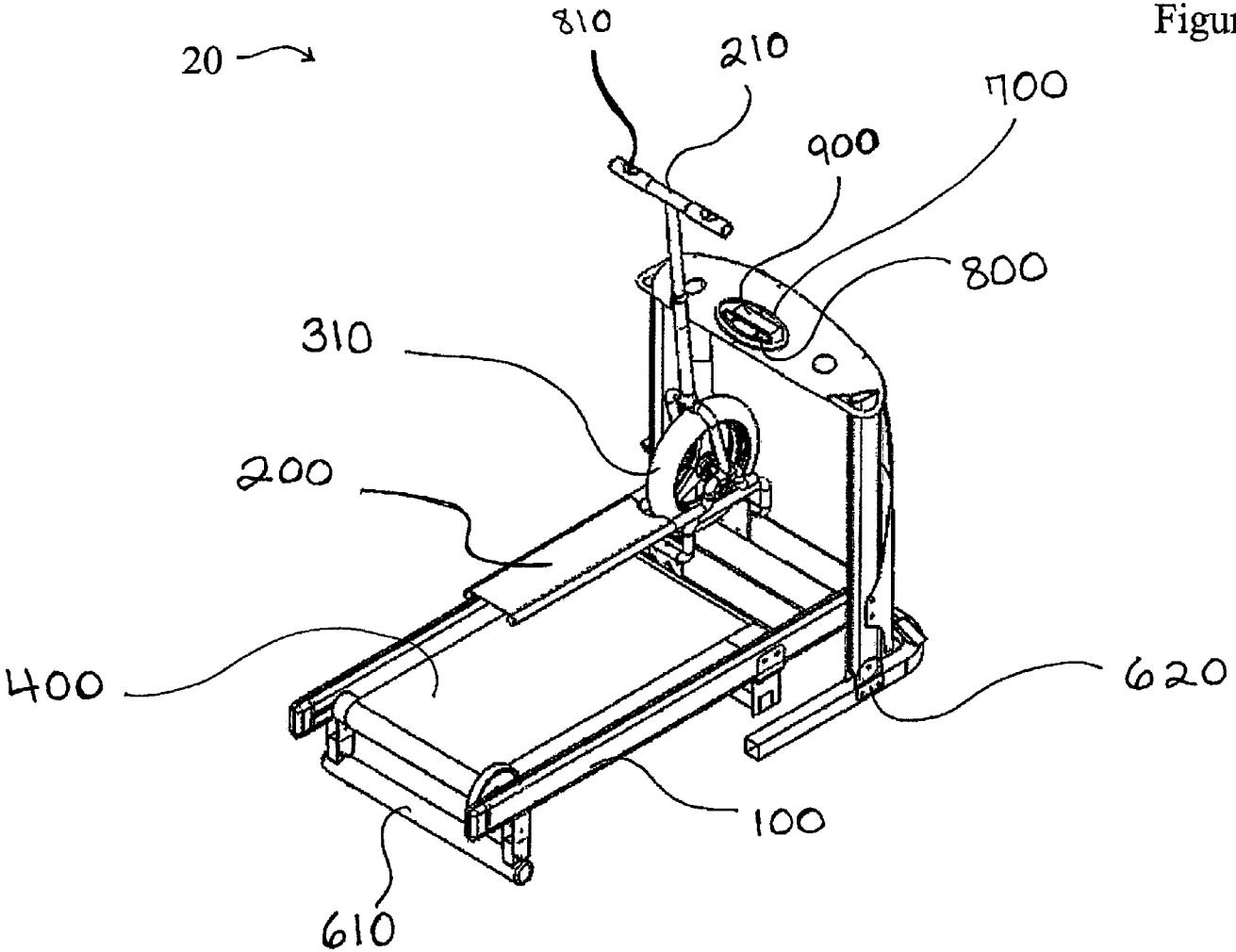
FIG. 2 illustrates an angled side perspective of an embodiment of the present invention. The Stationary Exercise scooter, illustrated generally at 20, may be configured to have a main body frame 100 with an unstable platform 200 positioned upon it, a platform control mechanism 210, one or more rotation kick treads 400, an adjustable incline foot 620, an incline joint 610, a computing device 700, a user control interface 800, a biometric interface 810, and a display device 900. In the best mode, a wheel 310 is for ornamental purposes only.

FIG. 2 illustrates an angled side perspective of an embodiment of the present invention. The Stationary Exercise scooter, illustrated generally at 20, may be configured to have a main body frame 100 with an unstable platform 200 positioned upon it, a platform control mechanism 210, one or more rotation kick treads 400, an adjustable incline foot 620, an incline joint 610, a computing device 700, a user control interface 800, a biometric interface 810, and a display device 900. In the best mode, a wheel 310 is for ornamental purposes only. The device illustrated in FIG. 2, shown generally at 20, shows the platform control mechanism 210 attached to the unstable platform 200. It should be appreciated that the platform control mechanism may be a handle as illustrated here, or the unstable platform may have attached or integrated, single or multiple, handles, fasteners, friction material, or other material to assist in keeping the user's feet or body on the unstable platform. The device may have a shorter handle or handles for kneeling or sitting, knee pads for keeling, a seat for sitting, a means for lying or otherwise riding, or a combination thereof.

A kick tread 400 placement is illustrated in FIG. 2, below the unstable platform, thus enabling a user to stand on the unstable platform and kick the tread. A single or multiple kick treads may be situated in alternative configurations, or the device may have no kick tread at all.

FIG. 2 illustrates an incline device comprising an incline joint 610, and an adjustable incline foot 620. By adjusting the adjustable incline foot 620, the main body frame 100 may pivot at one or more incline joints 610. It should be appreciated that the device components may also be adjusted separately or together, and in different configurations. It should be appreciated that the incline device may be activated manually, mechanically, by motor, pneumatically, hydraulically, or otherwise, and that the incline device may embody different configurations.

As indicated in FIG. 2, two incline joints 620 enable the main body frame 100 to pivot and adjust the angle of the unstable platform 200 and tread incline 400. The computing device 700, as illustrated in FIG. 2, receives, processes, and sends information. It should be appreciated that the computing device 700 may be multiple computing devices, and may support sensors, gaming applications, health and physical therapy optimization applications, machine operation controls, and bio-measurement devices.

The user interface 800, as illustrated in FIG. 2, enables a user to interact with the device and its components. It should be appreciated that the user interface may be multiple interfaces, and serve multiple purposes, such as functionality adjustment of some or all component parts. A user interface may collect user response information, deliver information from the user to a component part, or from a component part to the user, or a combination thereof. Such an interface may be analogue, digital or a combination thereof, and may be independent or integrated into any of the other component parts of the invention.

The bio-metric interface 810, as illustrated in FIG. 2, enables biological data capture from a user, such as heart rate, breathing rate, breath volume, and weight. The illustration indicated here indicates a device for heart rate capture and measurement. It should be appreciated that the bio-metric interface may be any type of biological measurement interface, including electromagnetic, pneumatic, gravitational, or otherwise, and may be integrated into, or separate from any of the component parts. The display device 900 is illustrated in FIG. 2. It should be appreciated that a display device may be visual, audible, tactile, or any other means of sensory display. It should be appreciated that the display may provide output from any of the component parts of the invention, whether digital, analogue, or otherwise.

It should also be appreciated that in the present invention, additional computing devices, display devices, transceiver devices, and bio-interfaces may be incorporated with the present invention, either individually or with any or all of the component parts, for enhanced enablement of exercise, physical therapy and entertainment.

FIG. 3

Figure 3:
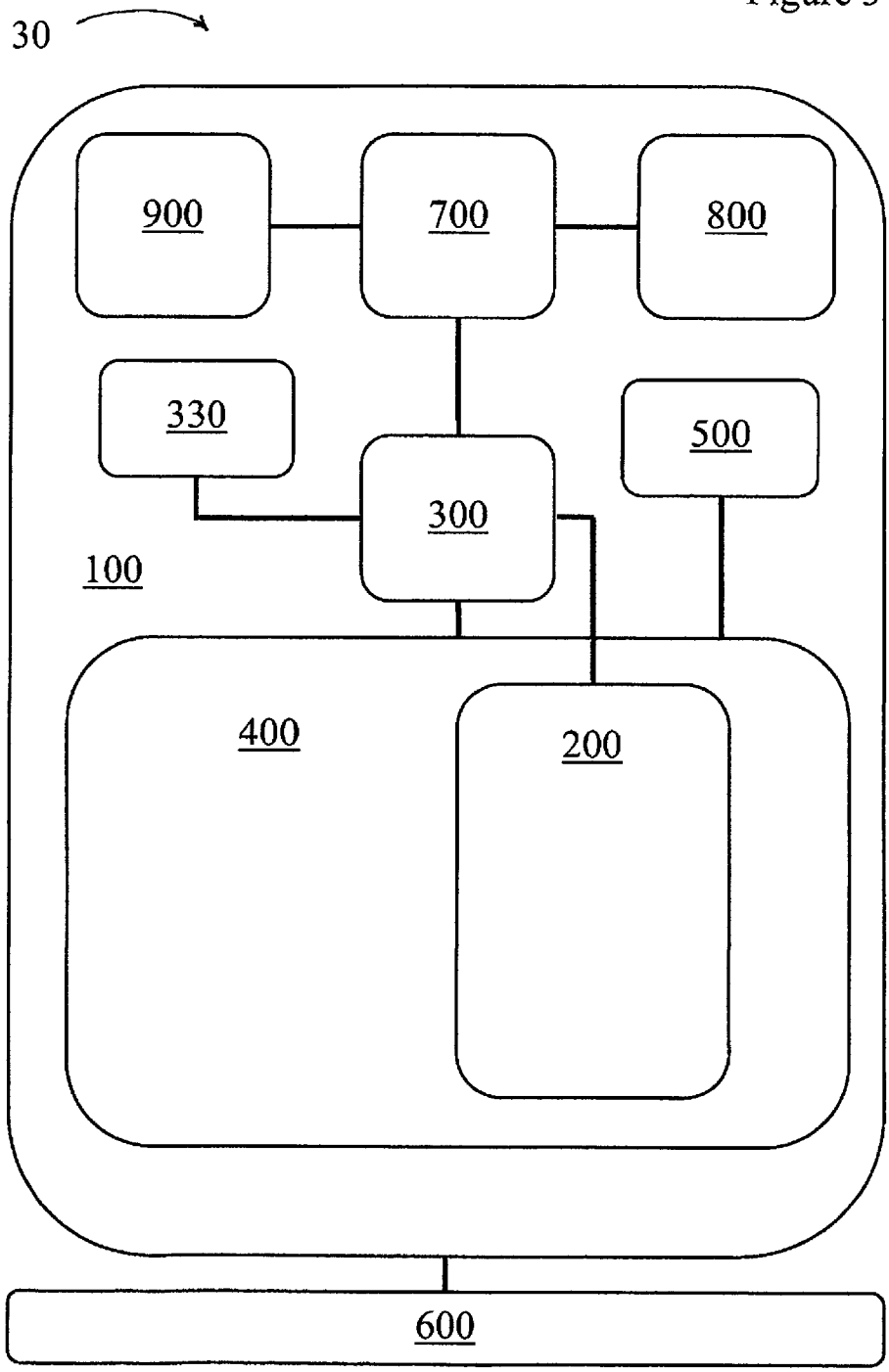
FIG. 3 illustrates a generalized schematic of the invention. The Stationary Exercise Scooter, illustrated generally at 30, shows a main body frame 100 with an unstable platform 200, a horizontal-axis, rotational, balance mechanism 300, an adjustable platform positioning mechanism 330, one or more kick treads 400, one or more variable resistance mechanisms 500, one or more incline devices 600, a computing device 700, a user control interface 800, and a display device 900.

FIG. 3 illustrates a generalized schematic of the invention. The Stationary Exercise Scooter, illustrated generally at 30, shows a main body frame 100 with an unstable platform 200, a horizontal-axis, rotational, balance mechanism 300, an adjustable platform positioning mechanism 330, one or more kick treads 400, one or more variable resistance mechanisms 500, one or more incline devices 600, a computing device 700, a user control interface 800, and a display device 900. It should be appreciated that FIG. 3 is a representational illustration of the invention, is not drawn to proportional scale, and illustrates an element of the inventive concept. The unstable platform 200 is illustrated in FIG. 3. It should be appreciated that the unstable platform may be one or more platforms. The unstable platform or platforms may be an actual or approximated scooter board, a skateboard, a surfboard, a ski or skis, a wakeboard, a knee board, a sled, or any other board or platform permutations of the generally broad field of board sports, or boards or platforms for exercise, physical therapy, or entertainment.

The horizontal-axis, rotational, balance mechanism 300 is positioned in front of and underneath the unstable platform 200, as represented in FIG. 3. It should be appreciated alternative configurations of the platform movement mechanism may be positioned below the unstable platform, adjacent to the unstable platform, above the unstable platform, in a combination of these placements, or elsewhere to enable platform movement. The kick tread illustrated in FIG. 3 at 400 enables a user to approximate or effectuate a kicking motion while using the stationary exercise scooter, and is described further at FIG. 4.

The variable resistance mechanism 500, as shown in FIG. 3, enables control of the movement speed of the kick tread 400 and is independent of the horizontal-axis, rotational, balance mechanism 300. It should be appreciated that the number of variable speed mechanisms 500, or horizontal-axis, rotational, balance mechanisms 300, may vary independently or together, from zero, one as shown, two, or more than two.

The incline device, as shown in FIG. 3 at 600, operates to control the incline adjustment of the unstable platform 200 and kick treads 400, by enabling incline adjustment of the main body frame 100. The incline of the device or its components enables a user to create exertion variations, thus tailoring an exercise, physical therapy or entertainment experience for more specifically desired results. It should be appreciated that the number and configuration of incline devices may vary from zero, one, or more than one to effect the incline of the device as a whole, or any of the component device parts, whether independently or in connection with each other.

The computing device 700, as illustrated in FIG. 3, receives, processes, and sends information. It should be appreciated that the computing device 700 may be multiple computing devices, and may support sensors, digital software applications for gaming, health physical therapy optimization, or otherwise, as well as machine operation controls, and bio-measurement devices. The user interface 800, as illustrated in FIG. 3, enables a user to interact with the device and its components. It should be appreciated that the user interface may be multiple interfaces, and serve multiple purposes, such as functionality adjustment of some or all component parts. The user interface may collect user response information, deliver information from the invention to the user, or a combination thereof. Such an interface may be analogue, digital or a combination thereof, and may be independent or integrated into any of the other component parts of the invention.

The display device 900 is illustrated in FIG. 3. It should be appreciated that the display device may be visual, audible, tactile, or any other means of sensory display. It should be appreciated that in the present invention, additional computing devices, display devices, transceiver devices, and bio-interfaces may be incorporated with the present invention, either individually or with any or all of the component parts, for enhanced enablement of exercise, physical therapy and entertainment.

FIG. 4

Figure 4:
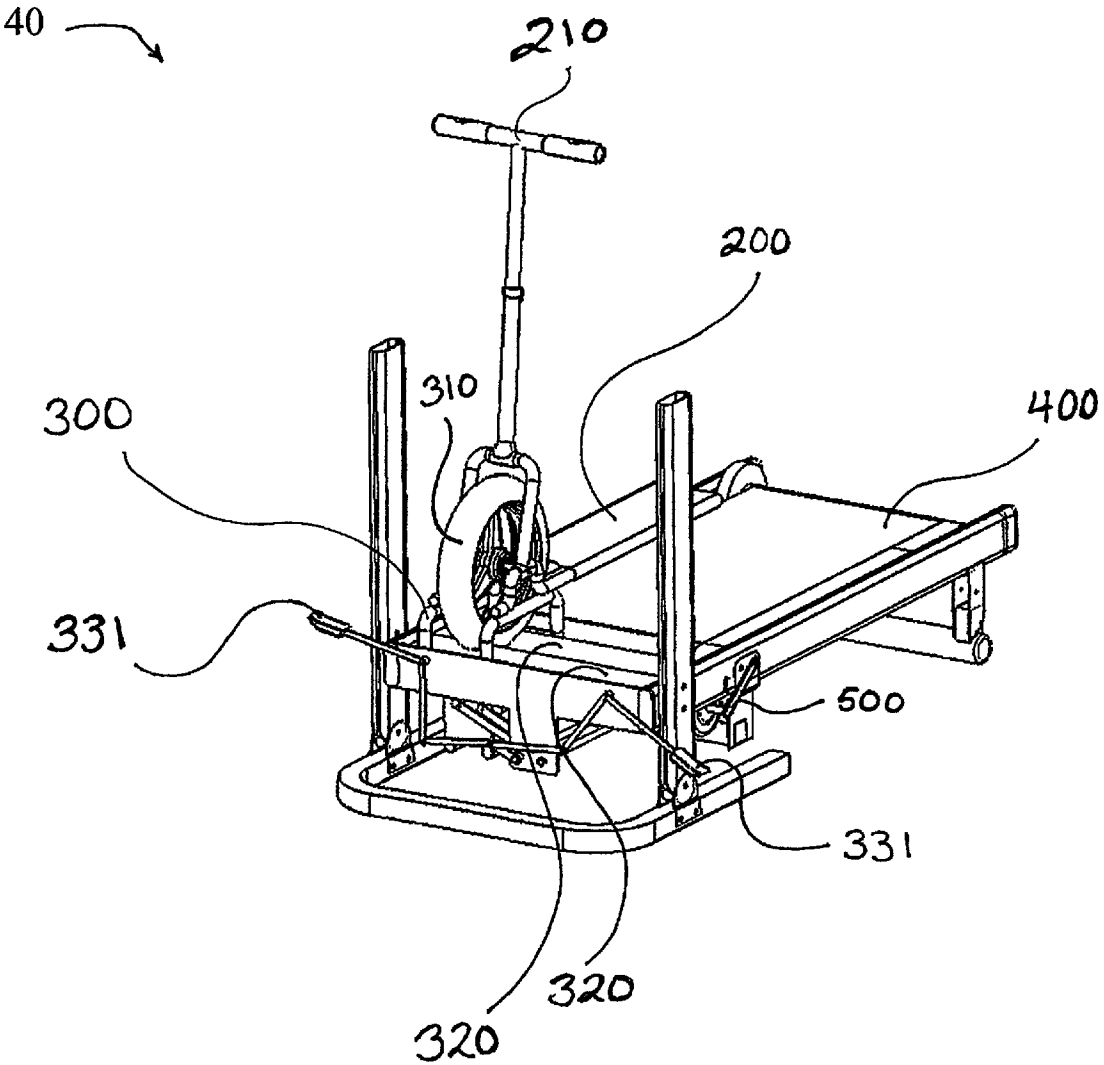
FIG. 4 illustrates a platform movement mechanism, illustrated generally at 40. Attached to an unstable platform 200 is a platform control mechanism 210, and a horizontal-axis, rotational, balance mechanism 300, which enables the unstable platform to rotate from side to side around a horizontal axis. Rollers 320 turn in relation to the movement of the kick tread device 400, and the platform movement mechanism enables the unstable platform to tilt from side to side around a horizontal axis, requiring the user to balance on the unstable platform in a same or similar manner as would be experienced if riding a moving scooter across the surface of a flat, tilted, undulating, or rugged plane. A wheel 320 serves no utilitarian purpose, but is ornamental in nature only. The unstable platform and platform movement mechanisms may be positionally adjusted by activating the position shifting levers 331. In the best mode, a wheel 310 is for ornamental purposes only.

FIG. 4 illustrates a platform movement mechanism, illustrated generally at 40. Attached to an unstable platform 200 is a platform control mechanism 210, and a horizontal-axis, rotational, balance mechanism 300. One or more roller 320 turns in relation to the movement of the kick tread device 400, and the platform movement mechanism enables the unstable platform to tilt from side to side, rotating around a horizontal axis, requiring the user to balance on the unstable platform in a same or similar manner as would be experienced if riding a moving scooter across the surface of a flat, tilted, undulating, or rugged plane. The unstable platform 200, horizontal-axis, rotational, balance mechanism 300, and platform positioning mechanism may be positionally adjusted by activating the position shifting levers 331.

It should be appreciated that the unstable platform 200 may be one or more platforms, and that if more than one platform, the platforms may move independently or in relation to each other. It should be appreciated that the unstable platform may pivot on a single axis, pivot on multiple axes, glide on top of a moving surface, glide on top of a stationary surface, or achieve movement in an alternative manner or mechanism. The horizontal-axis, rotational, balance mechanism 300 enables side to side rotational movement of the unstable platform 200 around a horizontal axis running parallel with the unstable platform. The rollers 320 turn in relation to kick tread 400 movement. It should be appreciated that the rollers and the platform movement mechanism may turn independently of the kick tread.

It should also be appreciated that the platform movement mechanism may also integrate with or be a track, tread, belt, roller, hydraulic, pneumatic, air cushion, electromagnetic, hydrostatic, geared, or other means of enabling desired movements of the unstable platform.

The unstable platform may be fixed, rolling, sliding, free-floating, or otherwise situated to enable the desired movement of the device. It should be appreciated that the platform movement mechanism 40 may be powered directly or indirectly by human movement, gears, pedal, or by other source of energy input, whether in relation to or independent of human movement, thus enabling mobility of the platform movement mechanism.

In FIG. 4, the placement of the kick surface 400 is underneath the unstable platform, thus enabling a user to balance on the unstable platform 200 with one leg, and to use the other available leg for standing, kicking, stepping or in a running motion on either side of the unstable platform. It should also be appreciated that a single or multiple tread devices may be situated in alternative configurations to enable alternative exercise, physical therapy and entertainment uses.

It should also be appreciated that the rotational kick tread 400 may be powered by the human user, electrically, or by other energy input source, or a combination thereof, thus enabling rotational movement of a belt. The tread device may operate independently or in association with the unstable platform mechanism. The kick tread 400 in FIG. 4 is shown as a treadmill belt. It should be appreciated that the tread device belt may also be a rotational or non-rotational pedal, sliding mechanism, a track, a gear, or other device enabling human or non-human induced energy transfer.

Figure 5:
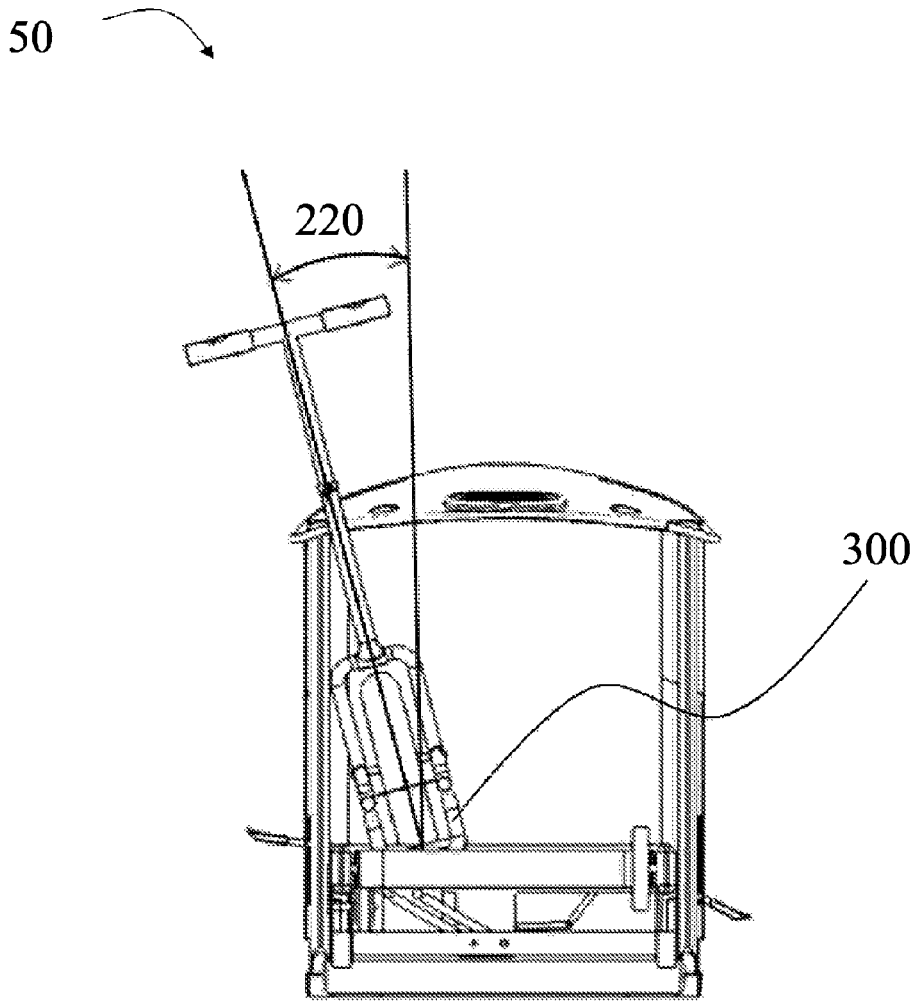
FIG. 5 An aspect result of the horizontal-axis, rotational, balance mechanism 300 is illustrated in FIG. 5, generally at 50. Side to side movement 220 is enabled by the device, enabling the user to balance on an unstable platform.

The variable resistance mechanism 500, as shown in FIG. 5, enables a user to adjust resistance on the platform movement mechanism, but causing resistance in the kick tread and rollers. It should be appreciated that the variable resistance mechanism may be integrated with any element of the device to effect movement resistance. In the best mode, a wheel 310 is for ornamental purposes only.

FIG. 5

An aspect result of the horizontal-axis, rotational, balance mechanism 300 is illustrated in FIG. 5, generally at 50.

Side to side movement 220 enables the user to balance on an unstable platform. The balance mechanism is attached to lift plates, and moves on an axis.

The illustration here indicates movement from where the unstable platform and rotational axis of the horizontal-axis, rotational, balance mechanism are level, to a tilted position to one side, as a result of a lower rotational axis in the horizontal-axis, rotational, balance mechanism. The tilt in the present invention is also enabled to the other side of on the rotational axis.

It should be appreciated that movement of the balance mechanism, as well as the unstable platform, may, in other embodiments, generally be on one or more axis, and move in any direction, such as forward and backward, up and down, side to side, twisting in any or all directions, or a combination of these directional movements.

FIG. 6

Figure 6:
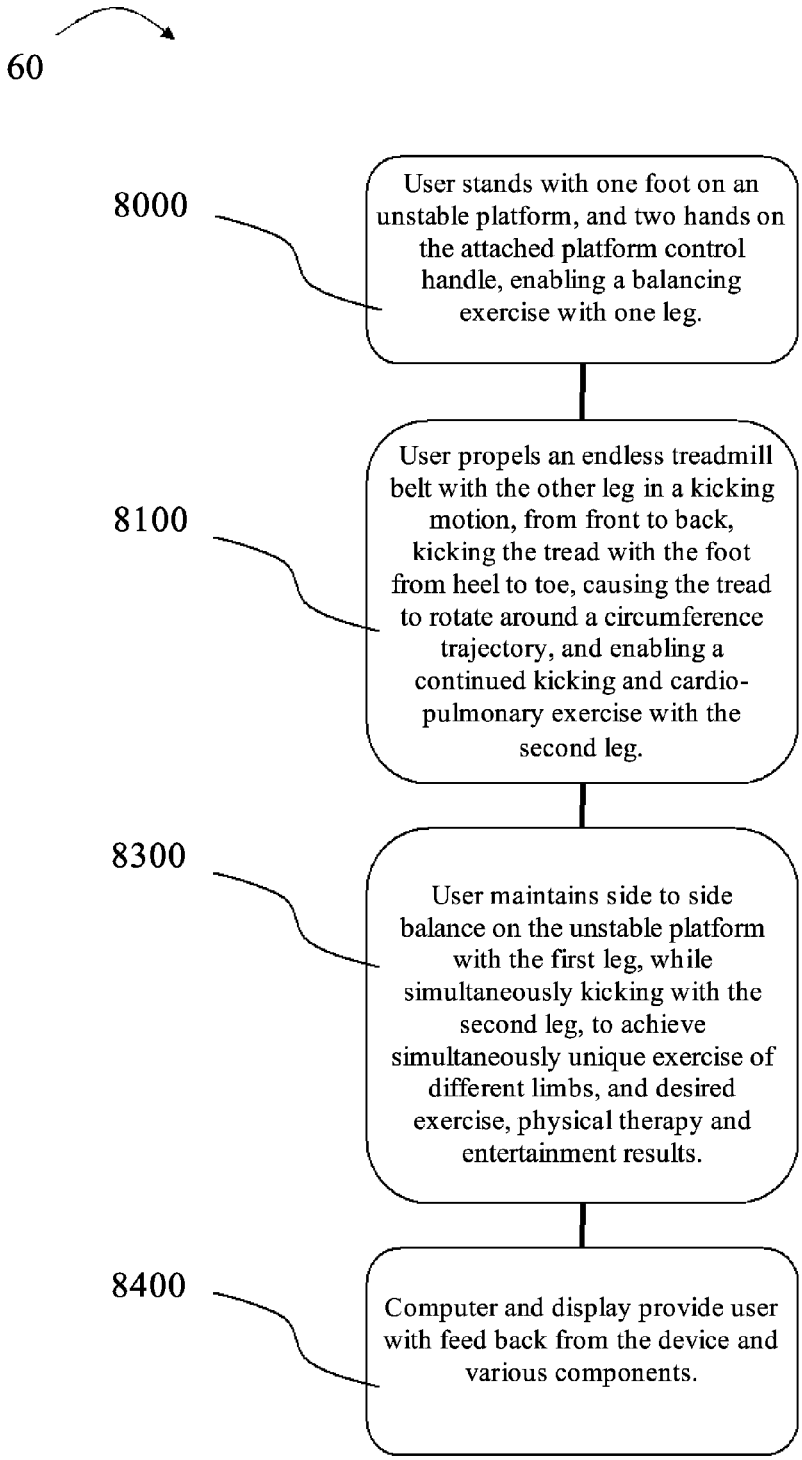
FIG. 6 A schematic for a generalized method of operation for the Stationary Exercise Scooter is shown in FIG. 6, as demonstrated generally at 60, where a user stands with one foot on an unstable platform, and two hands on an attached platform control mechanism, enabling a balancing exercise with one leg 8000. As the user propels a kick tread with the other leg in a kicking motion, from front to back, kicking the tread with the foot from heel to toe, the kick tread is caused to rotate around a circumference trajectory, enabling a continued kicking exercise with the second leg, and cardiopulmonary exercise 8100.
Figure 7:
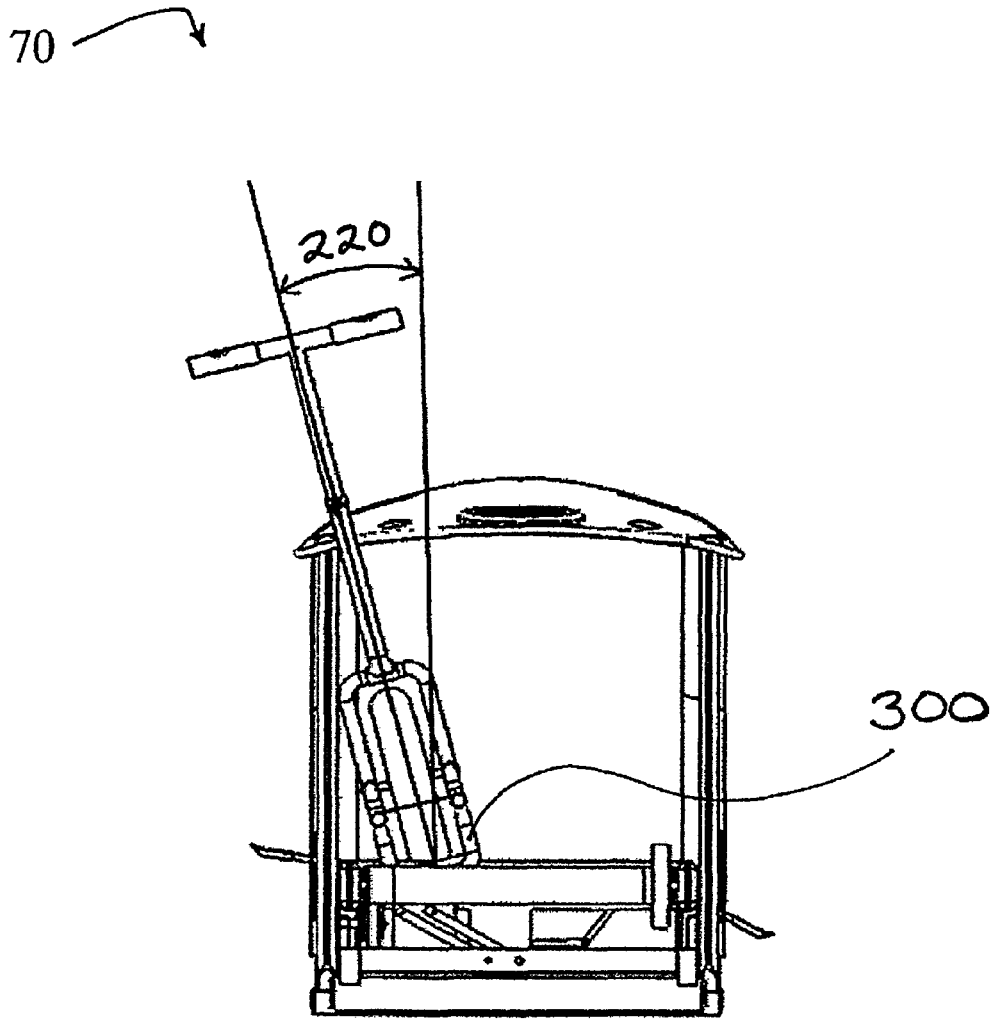
Figure 8:
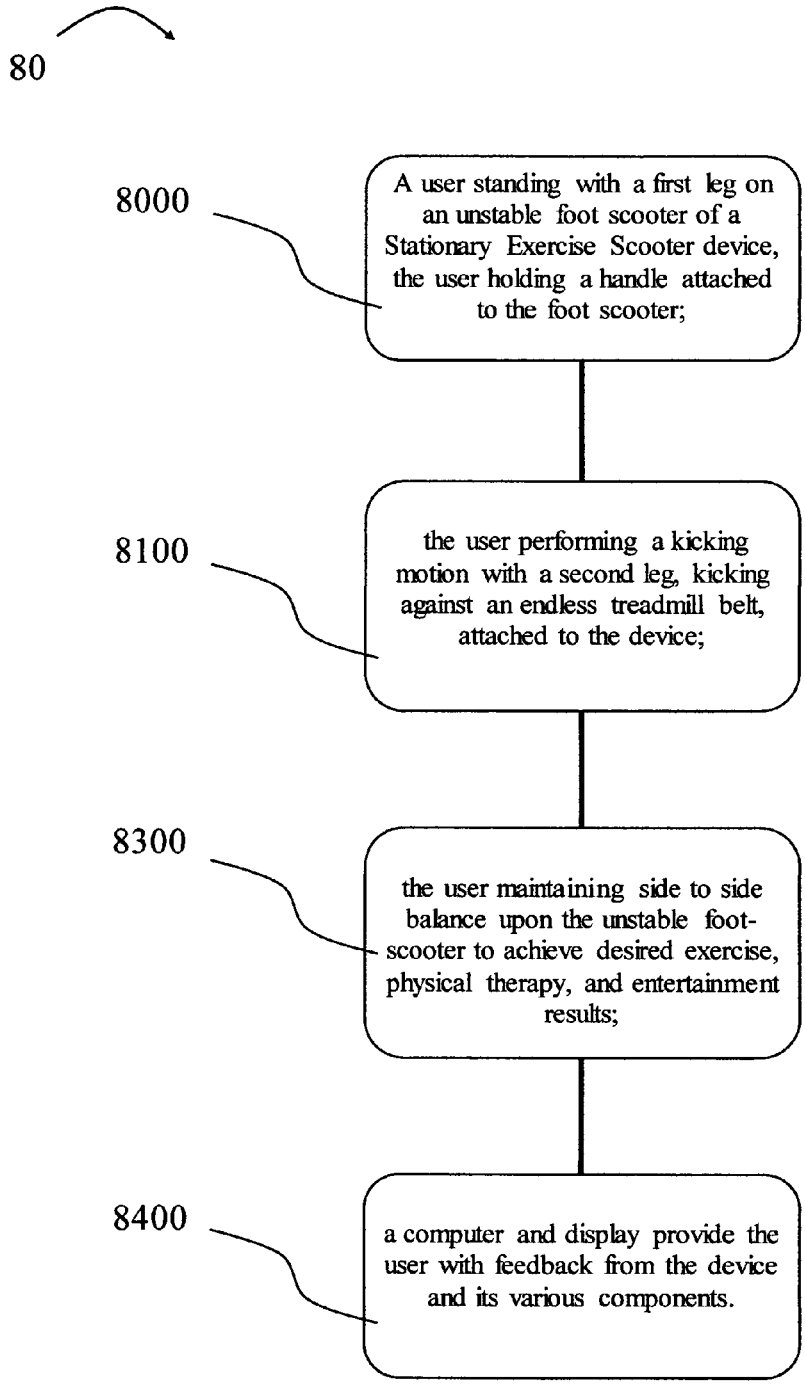

The FIG. 6 schematic, as shown generally at 60, suggests a method of use for the present invention in which a user stands with one foot on an unstable platform and two hands on an attached platform control mechanism, enabling a balancing exercise with one leg 8000.

As the user propels a kick tread with the other leg and foot in a kicking motion, from front to back, kicking the tread from heel to toe, causing the tread to rotate around a circumference trajectory, and enabling a kicking and cardiopulmonary exercise with the second leg 8100.

User maintains side to side balance on the unstable platform with the first leg, while simultaneously kicking with the second leg, to achieve simultaneously unique exercise of different limbs, and the desired exercise, physical therapy and entertainment results 8300.

A computer and display provide user feedback from the device and its various components 8400.

It should be appreciated that the user may also use both feet on a single unstable platform or multiple platforms, and the user may also kneel, sit, lie, stand, or otherwise position oneself on the unstable platform. The user may or may not use a platform control mechanism.

Propulsion movement may also be made using hands, arms, fixed attachments, independent tools, or any other means of human induced energy transfer, or by nonhuman-induced mechanical movement. It should also be appreciated that the user may simply balance on the unstable platform, without the use of the kick treads.

Alternative uses and user interactions with component parts of the invention may be performed, and the method illustrated here, as the best mode, is in no way intended to limit the inventive concept, its configuration or manner of use.

CONCLUSION

The stationary exercise scooter described here demonstrates a novel device for exercise, physical fitness, physical therapy, strength, balance, mental fitness and entertainment. The embodiments and examples set forth herein are presented to best explain the present invention and its practical application and to thereby enable those skilled in the art to make and utilize the invention. Those skilled in the art, however, will recognize that the description and examples are presented for the purpose of illustration and example only. Other variations and modifications of the present invention will be apparent to those of skill in the art, and it is the intent of the inventor that such variations and modifications be covered. The description as set forth is not intended to be exhaustive or limit the scope of the invention. Numerous variations and modifications are possible in light of the teaching without departing from the spirit and scope of the specifications. It is contemplated that the use of the present invention can involve components having different characteristics, and intended that the scope of the present invention be defined by the claims included here, giving full cognizance to equivalents in all respects.

The inventor claims:

1. An exercise and rehabilitation device, for use in a proximate space, comprising:
- at least one unstable foot-scooter for standing;
- at least one handlebar attached to the foot scooter for holding;
- a movement control mechanism; wherein said movement control mechanism enables the foot-scooter to tilt from side to side around a horizontal axis running parallel to the foot-scooter;
- at least one endless treadmill belt attached to a treadmill frame for kicking, wherein the foot scooter is connected to the treadmill through said movement control mechanism; and
- whereupon a user's first leg is placed on a foot scooter while the user's second leg kicks against an endless treadmill belt.

2. The exercise and rehabilitation device of claim 1, wherein said endless treadmill belt comprises a resistance device.

3. The exercise and rehabilitation device of claim 1, further comprising a computing device.

4. The exercise and rehabilitation device of claim 1, further comprising a bio-metric interface.

5. The exercise and rehabilitation device of claim 1, wherein the position of said unstable foot-scooter is adjustable between two or more fixed points.

6. The exercise and rehabilitation device of claim 1, further comprising an incline adjustment mechanism.

7. A method for using a stationary exercise scooter device, to achieve exercise and rehabilitation benefits of riding an unstable foot-scooter in a proximate space, wherein foot-scooter is connected to a treadmill through a movement control mechanism, comprising the steps of:
- standing with a first leg on an unstable foot-scooter;
- holding a handlebar attached to the foot-scooter;
- kicking against an endless belt of the treadmill with a second leg; and
- maintaining balance on the unstable foot-scooter upon tilting of the unstable foot-scooter from side to side around a horizontal axis running parallel to the foot-scooter.

8. An exercise device configured with an unstable foot scooter that moves in a proximate space, comprising:
- an unstable foot-scooter;
- at least one handlebar attached to the foot scooter;
- a movement control mechanism;
- a treadmill, said treadmill comprising:
  - a frame;
  - an endless belt as a kicking surface attached to said frame and located under said unstable foot-scooter; and
  - a treadmill friction tensioning mechanism;
- wherein said unstable foot-scooter is connected to the treadmill through said movement control mechanism; and wherein said movement control mechanism enables said unstable foot-scooter to tilt from side-to-side around a horizontal axis running parallel to said unstable foot-scooter; and
- whereupon a user's first leg is placed on said unstable foot scooter while the user's second leg is kicking against an endless treadmill belt.

9. The exercise device of claim 8, wherein said endless treadmill belt is a human powered endless treadmill belt.

10. The exercise device of claim 8, further comprising a computing device.

11. The exercise device of claim 8, further comprising a bio-metric interface.

* * * * *